US009175684B2

(12) United States Patent
McIntyre

(10) Patent No.: US 9,175,684 B2
(45) Date of Patent: Nov. 3, 2015

(54) ABUTMENT ROTARY PUMP WITH REPELLING MAGNETS

(71) Applicant: John McIntyre, Traverse City, MI (US)

(72) Inventor: John McIntyre, Traverse City, MI (US)

( * ) Notice: Subject to any disclaimer, the term of this patent is extended or adjusted under 35 U.S.C. 154(b) by 7 days.

(21) Appl. No.: 14/226,536

(22) Filed: Mar. 26, 2014

(65) Prior Publication Data

US 2015/0275896 A1 Oct. 1, 2015

Related U.S. Application Data

(63) Continuation of application No. 14/192,248, filed on Feb. 27, 2014, now abandoned.

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/356*** | (2006.01) |
| ***F04C 23/00*** | (2006.01) |
| ***F04C 2/46*** | (2006.01) |
| ***F04C 18/32*** | (2006.01) |
| ***F04C 2/356*** | (2006.01) |

(52) U.S. Cl.

CPC ..... *F04C 18/3564* (2013.01); *F04C 2/3566* (2013.01); *F04C 2/46* (2013.01); *F04C 18/322* (2013.01); *F04C 18/356* (2013.01); *F04C 23/008* (2013.01)

(58) Field of Classification Search

CPC ..... F04C 23/008; F04C 2/46; F04C 2/3566; F04C 18/322; F04C 18/356; F04C 18/3564; F01C 1/46; F01C 1/063

USPC ..... 418/63, 243, 248, 152–153

See application file for complete search history.

(56) References Cited

U.S. PATENT DOCUMENTS

| | | | | | |
|---|---|---|---|---|---|
| 715,933 | A | * | 12/1902 | Allen | 418/249 |
| 2,238,396 | A | * | 4/1941 | Rabezzana et al. | 174/152 S |
| 3,985,473 | A | * | 10/1976 | King et al. | 418/248 |
| 4,132,512 | A | * | 1/1979 | Roberts | 418/23 |
| 7,114,931 | B2 | * | 10/2006 | Wilk et al. | 418/259 |
| 2009/0238709 | A1 | * | 9/2009 | Youker et al. | 418/179 |
| 2011/0070115 | A1 | * | 3/2011 | Takahashi et al. | 418/248 |
| 2013/0129547 | A1 | * | 5/2013 | Pekrul | 418/1 |
| 2015/0071807 | A1 | * | 3/2015 | McIntye | 418/243 |

FOREIGN PATENT DOCUMENTS

| | | | | |
|---|---|---|---|---|
| GB | 628239 | * | 8/1949 | F04C 2/46 |

* cited by examiner

*Primary Examiner* — Theresa Trieu

(57) ABSTRACT

A rotary pump device includes a stator chamber with a cylindrical inner wall having intake and exhaust ports and an abutment mounted therein, and a rotor eccentrically mounted on an axial driven shaft for rotation within the chamber. The rotor keeps continuous wiping contact with the chamber wall while repelling magnets exert pressure on an abutment which maintains contact with the rotor to partition the intake and outlet ports. The repelling magnets act as a spring to assure contact of the abutment on the rotor while the pump is running or on standby. The repelling is caused by locating magnets positioned with similar facing poles in a pocket positioned against an abutment. A full intake/exhaust cycle takes place every 360° of rotor travel.

5 Claims, 2 Drawing Sheets

ABUTMENT ROTARY PUMP WITH REPELLING MAGNETS

CROSS-REFERENCE TO RELATED APPLICATIONS

This Continuation-In-Part application claims the benefit of U.S. patent application Ser. No. 14/192,248 filed Feb. 27, 2014 now abandoned.

FIELD OF THE INVENTION

The invention is in the field of pumps, and more particularly rotary pumps of the type having an abutment within a stator chamber with inlet and outlet ports.

BACKGROUND OF THE INVENTION AND DESCRIPTION OF RELATED ART

The term "abutment rotary pump" is used herein to refer to a device comprising a movable partition separating the inlet and outlet streams within a stator chamber or housing and a rotor that rotates within the chamber to cause sequential intake, compression, and the exhaust of a fluid medium such as a gas, a liquid, or combination thereof. The term, therefore, comprehends not only devices that cause fluid movement but also devices that compress or pressurize fluids with or without ignition or combustion. Further, the term "abutment rotary pump" embraces a reverse operation in which fluid drives a rotor rather than the rotor driving the fluid, i.e., in reverse operation every pump is effectively a motor. Existing abutment rotary pumps use complex linkages, weights on the abutment, and springs to assure abutment contact with the rotor.

One example of an abutment configuration is shown in U.S. Pat. No. 2,238,395 to Nittka. The pump in the Nittka patent comprises a rotor working in unison with a flap valve requiring numerous components. The device is characterized by the complexity of the many parts required to manipulate a flap valve.

Another example of an abutment configuration is shown in U.S. Pat. No. 715,933 to Allen. The engine and pump in the Allen patent comprises dual abutments working in unison with rotary valves with exhaust stream traveling through a port in the rotor expelled through the driveshaft. The device is complicated and requires several parts working in combination with the abutments.

An alternative abutment configuration is shown U.S. patent application Ser. No. 14/022,486 to applicant. A swinging abutment maintains contact with the rotor to partition the intake and outlet ports. The abutment is actuated primarily from the outlet pressure generated from a rotating rotor.

An example of utilizing magnets to repel in a pumping configuration is shown in U.S. patent application Ser. No. 12/050,498 to Youker and Jaques. Unlike the applicant, the Youker and Jaques "vane" rotary pump configuration uses repelling magnets in a less demanding or ancillary role. The Youker and Jaques invention more importantly requires in addition, various magnetized components and centrifugal force to slidingly engage the multiple vanes to effect pumping. The invention has many parts and is elaborate as compared to the of applicant's use of repelling magnets in an abutment configuration.

It would be advantageous to simplify pump abutments to seal working members within the confines of the stator.

BRIEF SUMMARY OF THE INVENTION

The present invention comprises a pump structure having a stator chamber with a substantially continuous wall with intake and exhaust ports and abutment pocket therein. The pump further comprises a centrically positioned shaft with an eccentrically mounted rotor within the chamber such that as the rotor rotates, the rotor maintains a wiping contact between a segment of the outside diameter of the rotor and the inner wall of the chamber. The abutment affixed in the abutment pocket maintains contact with the outside diameter of the rotor to effect intake, compression, and exhaust functions with each 360° (degrees) of rotor movement. The abutment is pressured by magnets with poles of the same polarity facing each other. Since magnets of the same polarity repel each other, this force is applied to an abutment to provide continuous wiping contact with the outside diameter of the rotor. The intake and exhaust ports are spaced-apart from each other and separated by the partition of the abutment.

In the illustrative embodiment, the chamber inner wall is cylindrical and the rotor is comprised of a cylindrical body with a segment having contact with the chamber inner wall so that each 360° of rotation the rotor body is in contact with the inner wall except momentarily when the rotor is only in direct contact with the abutment. In the illustrative embodiment, the rotor body and driven post are shown as a solid part.

In accordance with a preferred embodiment hereafter described, the intake and exhaust ports are spaced-apart from each other and separated by the partition of an abutment, an abutment that utilizes repelling magnets. As will be understood from the following specification, the pump of the present invention can be scaled to any desired capacity with pump, abutment, rotor and shaft components being constructed using any material or combination of materials including hard dense plastics, ceramics, cermets, and/or non-magnetic metals.

These and other features and advantages of the invention will become apparent from the detailed description below, in light of the accompanying drawings.

BRIEF DESCRIPTION OF THE DRAWINGS

For purposes of clarity and brevity, like elements and components will bear the same designations and numbering.

DETAILED DESCRIPTION OF THE INVENTION

Figure 1:
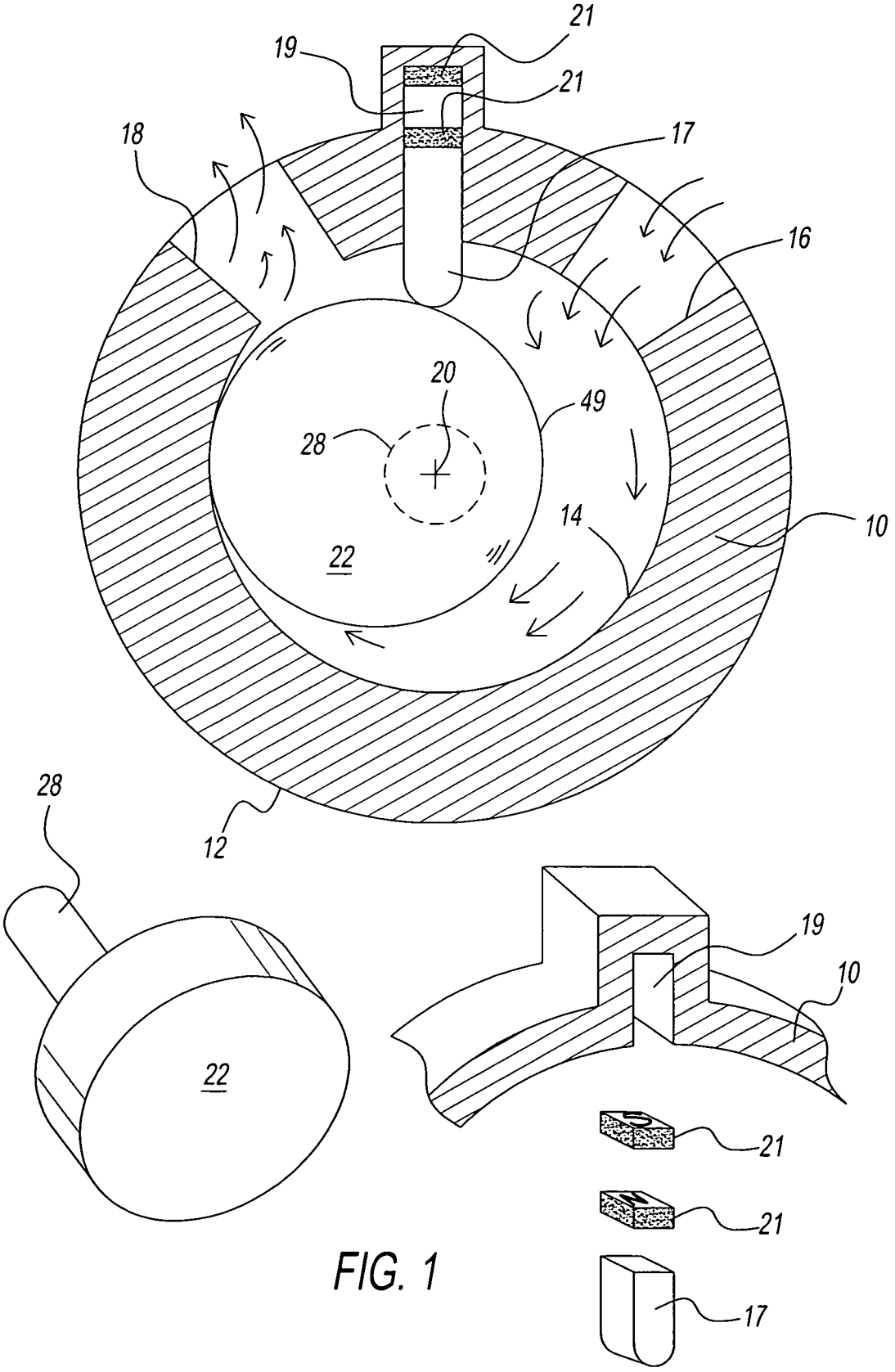
FIG. 1 has a plan view of an abutment rotary pump embodiment of the invention with the rotor in contact with the abutment that separates the intake port and exhaust port and an exploded detail view of the abutment pocket, magnets, and abutment. Also shown is a perspective view of a one piece rotor and driven post.

Referring to FIG. 1, there is shown a rotary pump 10 comprising a stator 12 defining a cylindrical chamber having an inner wall 14 interrupted only by the spaced-apart intake (inlet) and exhaust (outlet) ports 16 and 18 respectively and the abutment pocket 19 that accommodates the abutment 17. It is understood that a cover plate or other structure (not shown) closes the chamber when all parts described are installed. The chamber is cylindrical as defined by the inner wall 14, and has a geometric center at 20. The abutment 17 is located between intake and exhaust ports, 16 and 18. The abutment 17 is affixed in the abutment pocket 19 which also accommodates magnets 21 positioned with same poles facing each other so that repelling occurs. Note "S" for South and "N" for North lettering on the magnets to illustrate pole position. The repelling magnets exert spring like pressure on the abutment 17 which then maintains continual contact on the rotating rotor outer wall 49. As shown, the magnets 21 are positioned above the abutment 17 in the abutment pocket 19.

An eccentrically mounted rotor 22 is comprised of a cylindrical body for rotation with an input structure, the axial driven post or shaft 28. With rotation in a clockwise rotation when viewing the pump 10 a segment of the outside diameter of the rotor 22 is in contact against the inner wall 14. During rotation, there is continuous wiping contact with the chamber inner wall 14.

Rotor drive comes from driven post or shaft 28, its location is the geometric center of the stator 20. The rotor 22 and driven post or shaft 28 can be comprised from a single piece of material. FIG. 1 includes a perspective view of a single piece rotor and driven post. The solid rotor and driven post can be molded, cast, and/or machined for strength and economy of manufacture.

The invention utilizes repelling magnets to mechanically pressure abutments of rotary pumps. With the advent of rare earth magnets, magnetic forces have increased and the relative sizes of the magnets have decreased which makes this application ideal. These very strong permanent magnets are made from alloys of rare earth elements such as Neodymium and Samarium Cobalt. The invention can also incorporate other magnet types such as Ferrite or Alnico. Also shown in FIG. 1 is an exploded detail view of the pump 10, abutment pocket 19, magnets 21, and abutment 17 of the abutment rotary pump embodiment.

The repelling magnets exert downward pressure on the abutment even while the pump is not operating always effecting a seal on the rotor and therefore partitioning the intake and exhaust ports. Springs are sometimes used to force an abutment against the rotor. Springs are subject to taking a set when kept in a stationary position which can happen during periods of pump non-operation. Springs can fatigue rather quickly in high speed applications. Also, extra space is required to accommodate the overall length of the spring as compared to compact rare earth magnets. When the pump is running, the abutment as result of the constant energy exerted by the repelling magnets allows intake, compression and exhaust functions of the rotating rotor. The magnets must not be in the proximity of magnetic materials which would deter their function in this application.

Figure 2A:
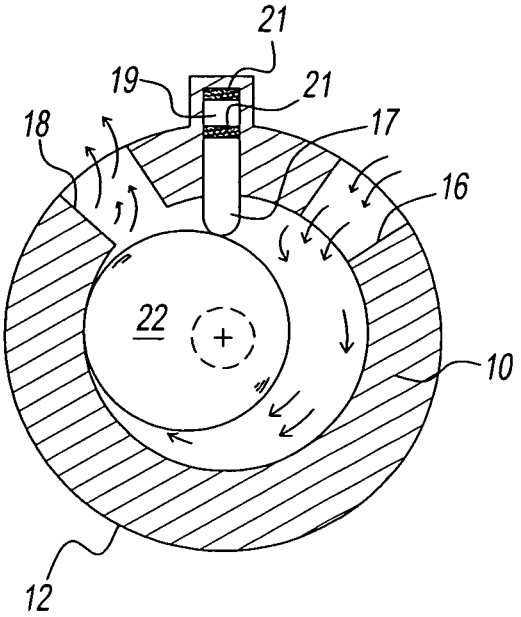
FIGS. 2A-2D make up a schematic, sequential showing of the rotor and abutment position over approximately 360° of rotation.

Referring now to FIGS. 2A-2D, a description of operation will be given. FIGS. 2A-2D represents progressively different degrees of rotor position over about 360° of travel in a clockwise direction. FIG. 2A corresponds in rotor position to FIG. 1.

In FIG. 2A, the rotor is nearing full upward movement of the abutment 17. Note pump 10 and the gas or liquid flow indicated by directional arrows entering inlet port 16 and exiting outlet port 18 and position of rotor 22.

Figure 2B:
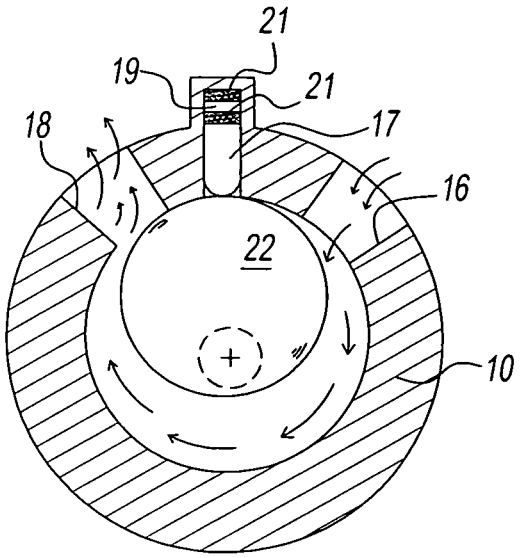

In FIG. 2B, the rotor 22 has pushed the abutment 17 into the topmost position in the abutment pocket 19. The rotor has wiping contact with the inner wall except momentarily when the rotor body is in direct contact with the abutment as shown. It is critical to design clearance between the magnets for this abutment position. For safety, the magnets should never contact because they could chip, crack or shatter. Remarkably at this time, the repelling exerted by the magnets on the abutment is peaking when needed the most. Again, the magnets repelling pressure on the abutment and consequently the rotor is variable and continuously matches the rotor movement for sealing. The abutment 17 maintains a separation of the inlet and outlet ports 16 and 18 through every rotor rotation.

Figure 2C:
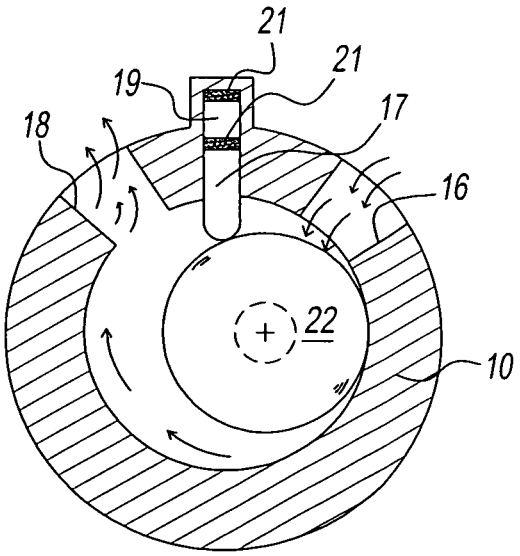

In FIG. 2C, the rotor begins both intake and compression stroke. Note in every sequential illustration there is a fluid medium going through the inlet 16 and outlet 18 ports as indicated by the directional arrows.

Figure 2D:
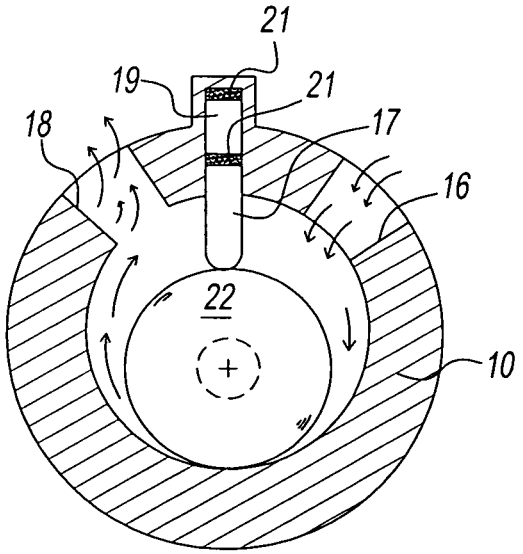

In FIG. 2D, the abutment 17 is fully extended out of the abutment pocket 19. At this time, the magnet repelling pressure on the abutment is at its lowest. During all positions, the rotor 22 is bringing about intake, compression, and exhausting a fluid medium such as a gas, a liquid, or combination thereof.

It will finally be understood that the disclosed embodiments represent presently preferred forms of the invention, but are intended to be explanatory rather than limiting of the invention. Reasonable variation and modification of the invention as disclosed in the foregoing disclosure and drawings are possible without departing from the scope of invention. The scope of the invention is defined by the following claims.

What is claimed is:

1. An abutment rotary pump comprising:

a stator defining a closed chamber having a continuous inner wall, with an intake and an exhaust port being formed in the inner wall at spaced-apart locations;

an abutment pocket formed in the inner wall located between the intake and exhaust port locations; and repelling magnets having a clearance between faces with the same polarity facing each other; wherein the repelling magnets positioned above an abutment to exert pressure on the abutment to continually contact a rotating rotor;

wherein the abutment affixed in the abutment pocket.

2. The abutment rotary pump as defined in claim 1, wherein materials of construction for the pump, rotor, driven post, and abutment are chosen from the group consisting of non-magnetic materials of plastics and ceramics.

3. The abutment rotary pump as defined in claim 1, wherein the inner wall is circular.

4. The abutment rotary pump as defined in claim 1, further comprising a driven post located at the geometric center of the chamber.

5. The abutment rotary pump as defined in claim 1, wherein the rotor and driven post are comprised from a single piece of material.

* * * * *